US008469098B2

(12) United States Patent
Xu

(10) Patent No.: US 8,469,098 B2
(45) Date of Patent: Jun. 25, 2013

(54) FORMATION TREATMENT SYSTEM AND METHOD

(75) Inventor: Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 296 days.

(21) Appl. No.: 12/852,882

(22) Filed: Aug. 9, 2010

(65) Prior Publication Data

US 2012/0031617 A1 Feb. 9, 2012

(51) Int. Cl.
*E21B 43/26* (2006.01)

(52) U.S. Cl.
USPC ..... 166/307; 166/177.5; 166/100

(58) Field of Classification Search
USPC ..... 166/307, 308.1, 100, 177.5
See application file for complete search history.

(56) References Cited

U.S. PATENT DOCUMENTS

| | | | | |
|---|---|---|---|---|
| 2,301,624 | A * | 11/1942 | Holt | 166/100 |
| 3,196,949 | A * | 7/1965 | Thomas | 166/100 |
| 3,395,758 | A * | 8/1968 | Kelly et al. | 166/100 |
| 3,765,484 | A * | 10/1973 | Hamby et al. | 166/278 |
| 3,878,889 | A | 4/1975 | Seabourn | |
| 3,924,677 | A | 12/1975 | Prenner et al. | |
| 4,050,529 | A * | 9/1977 | Tagirov et al. | 175/424 |
| 6,896,049 | B2 | 5/2005 | Moyes | |
| 7,252,162 | B2 | 8/2007 | Akinlade et al. | |
| 7,503,390 | B2 * | 3/2009 | Gomez | 166/323 |
| 8,109,340 | B2 * | 2/2012 | Doane et al. | 166/387 |
| 2005/0279501 | A1 * | 12/2005 | Surjaatmadja et al. | 166/278 |
| 2009/0266548 | A1 * | 10/2009 | Olsen et al. | 166/308.1 |

OTHER PUBLICATIONS

Constantine, Jesse. "Selective Production of Horizontal Openhole Completions Using ECP and Sliding Sleeve Technology." SPE Rocky Mountain Regional Meeting, May 15-18, 1999, Gillette, Wyoming. [Abstract Only].

Shumbera et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003, Denver, Colorado. [Abstract Only].

Vickery, Harold and Christian Bayne, "New One-Trip Multi-Zone Frac Pack System with Positive Positioning." European Petroleum Conference, Oct. 29-31, 2002, Aberdeen, UK. [Abstract Only].

Baker Oil Tools. "Z-Seal Metal-to-Metal Expandable Sealing Device Uses Expanding Metal in Place of Elastomers," Nov. 6, 2006.

International Search Report and Written Opinion; International Application No. PCT/US2012/038622; International Filing Date: May 18, 2012; Date of Mailing Dec. 6, 2012; 12 pages.

* cited by examiner

*Primary Examiner* — William P Neuder
(74) *Attorney, Agent, or Firm* — Cantor Colburn LLP

(57) ABSTRACT

A formation treatment system includes an annulus spanning member having one or more openings therein. A tubular having one or more ports therein in fluid communication with the one or more openings. A sleeve capable of isolating or communicating the one or more ports with an ID of the tubular. A method for effecting precision formation treatment is included.

20 Claims, 5 Drawing Sheets

FORMATION TREATMENT SYSTEM AND METHOD

BACKGROUND

In downhole industries such as hydrocarbon recovery, and Carbon Dioxide sequestration, for example, formation treatments such as "fracing" and "acidizing" are well-known parts of downhole processes designed to increase permeability in or stimulate a formation. In general, a fracing process includes the employment of hyperbaric pressures applied from a surface location and directed through ports in a tubing string. The increased pressure while it does indeed result in formation fracture does not necessarily fracture the formation in optimum or even very controlled locations. Acidizing is similarly less than optimumly targeted. Since fractures and acidizing points can dramatically improve the efficiency of a downhole completion, the art will well receive alternate formation treatment systems and methods.

SUMMARY

A formation treatment system includes an annulus spanning member having one or more openings therein; a tubular having one or more ports therein in fluid communication with the one or more openings; and a sleeve capable of isolating or communicating the one or more ports with an ID of the tubular.

A method for effecting precision formation treatment including setting an annulus spanning member in a formation to bring one or more openings in the annulus spanning member proximate a formation wall; revealing one or more ports in a tubular member; communicating a tubular ID to the one or more openings in the annulus spanning member; applying fluid through the tubular ID; and directing the fluid to the formation through the one or more openings.

A method for effecting precision formation treatment including deploying a plug member to a formation treatment system includes an annulus spanning member having one or more openings therein; a tubular having one or more ports therein in fluid communication with the one or more openings; and a sleeve capable of isolating or communicating the one or more ports with an ID of the tubular; setting the annulus spanning member in a formation to bring one or more openings in the annulus spanning member proximate a formation wall by pressurizing a chamber defined by the annulus spanning member and the tubular; revealing one or more ports in the tubular member by moving the sleeve pursuant to pressure upon the plug on a seat in the sleeve; communicating a tubular ID to the one or more openings in the annulus spanning member; applying a fluid through the tubular ID; and directing the fluid to the formation through the one or more openings.

BRIEF DESCRIPTION OF THE DRAWINGS

Referring now to the drawings wherein like elements are numbered alike in the several Figures.

DETAILED DESCRIPTION

Figure 1:
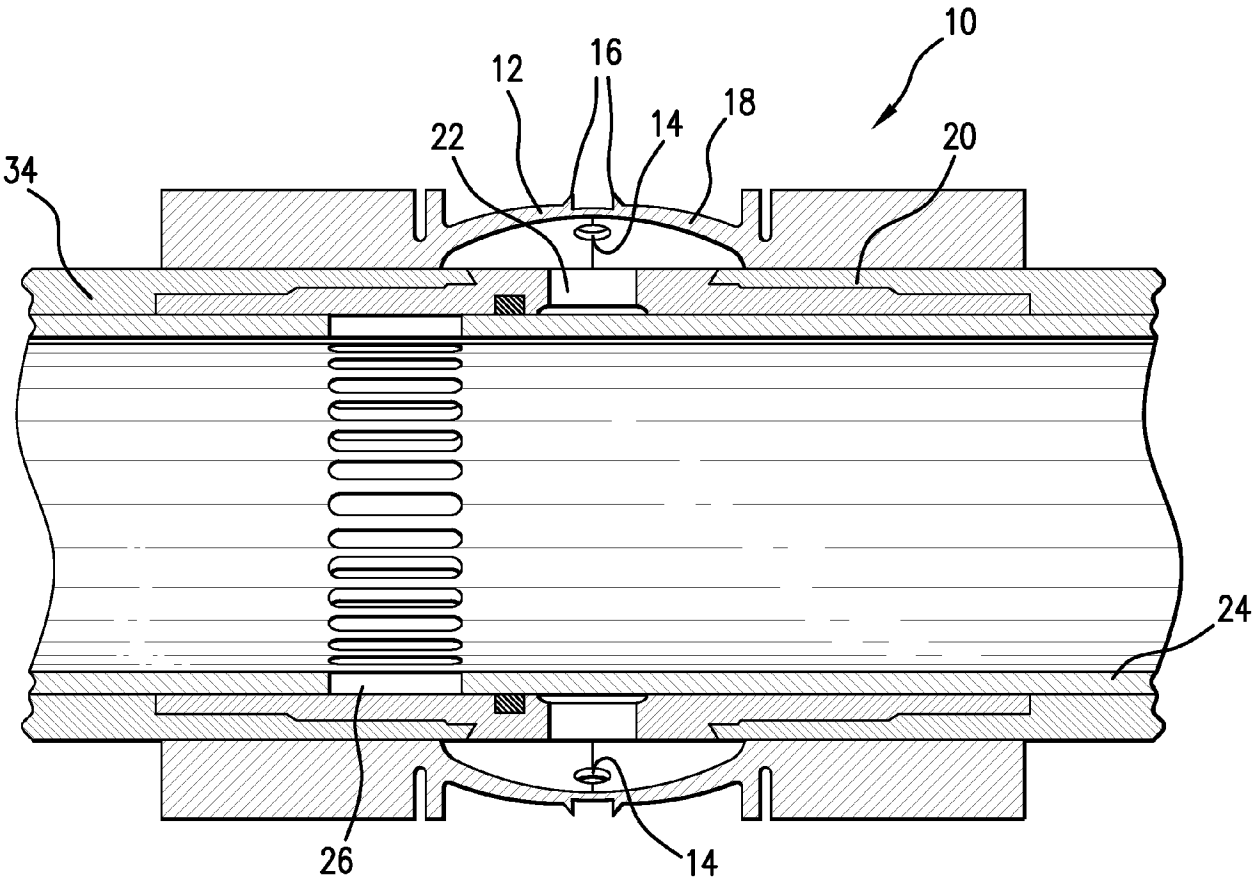
FIG. 1 is a cross sectional view of a first embodiment of a formation treatment system as disclosed herein in a run in position.
Figure 2:
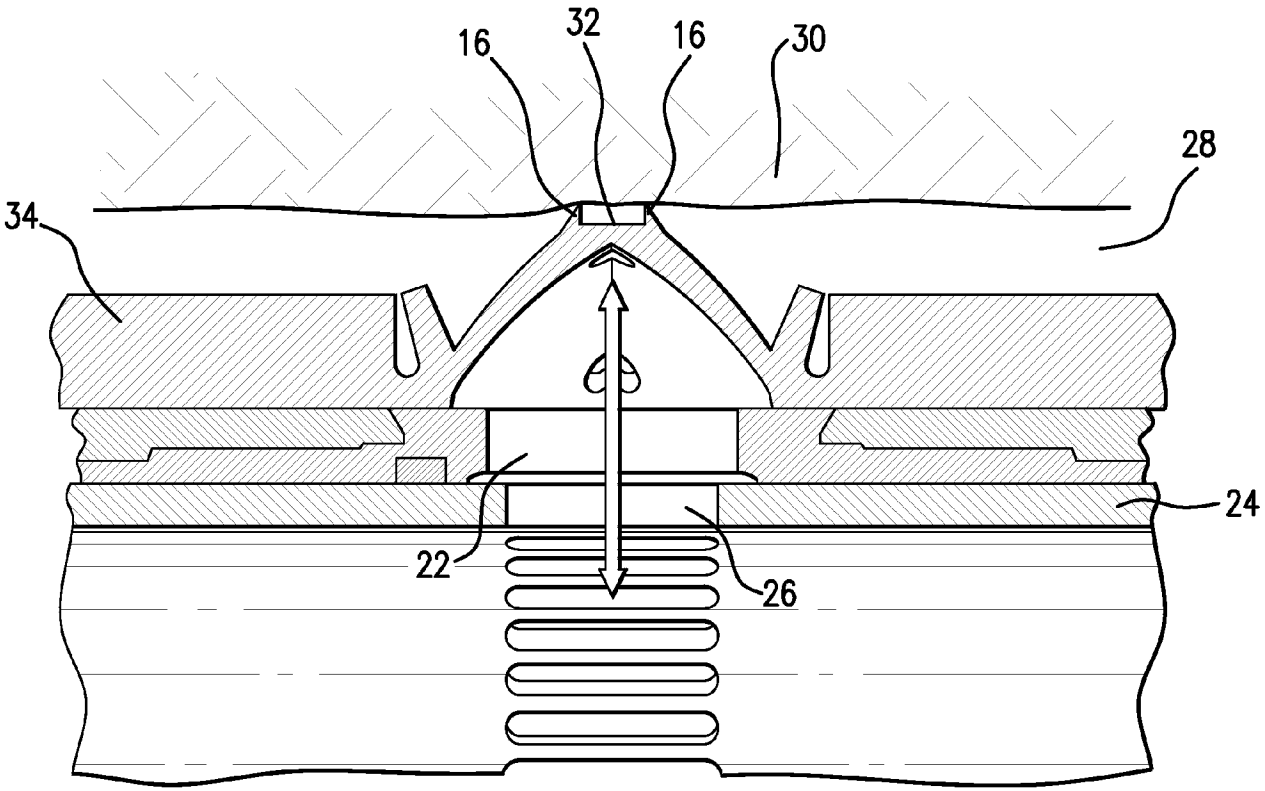
FIG. 2 is the formation treatment system of FIG. 1 in a formation treatment position.

Referring to FIGS. 1 and 2, a first embodiment of a formation treatment system 10 as disclosed herein is illustrated. The system 10 includes an annulus spanning member 12 (in a run-in or resting position) that may be a deformable element and may in some embodiments also act as a seal. The member 12 includes one or more openings 14 through which at least pressure is transmittable at selected times. It may however be desirable to plug the one or more holes at one or more times during the life cycle of the system. More information will be provided on this point later in this disclosure. In one embodiment the member 12 will include pips 16 that extend radially outwardly of a body 18 of the member 12 regardless of the position of the member 12. Member 12 is positioned radially outwardly of a tubular 20 that includes one or more ports 22. Further is a sleeve 24 acting as a valve in combination with the tubular 20. The sleeve includes one or more passageways 26 extending radially therethrough. The sleeve 24 is translationally supported within the tubular 20 such that the one or more passageways 26 are alignable and misalignable with the one or more ports 22.

In use, a first action is to cause the annulus spanning member 12 to span an annulus 28 between the system 10 and a formation 30 in which the system 10 is disposed. This can be done in a number of ways, some of which result in a compressive load being placed axially of the member 12, resulting in its deformation radially outwardly as shown in FIG. 2. Also notable in FIG. 2 is that the embodiment illustrated includes pips 16 and those pips 16 are embedded in the formation. This serves to segregate an annular space 32 in fluid connection with the one or more openings 14, the one or more ports 22 and the one or more passageways 26 to provide a fluid conduit from the formation 30 to an inside dimension ("ID") of the system 10. The pips, then, assist in directing fluid pressure to the target area. The segregation of the area is also useful for purposes such as matrix acidizing since due to the confined nature of application, less acid would be needed to effect the desired result of formation stimulation, for example.

Those of skill in the art will recognize the system will be a part of a string 34 and the "ID" will be fluidically accessible to surface for pressurization. As illustrated in FIG. 2, the sleeve 24 has already been shifted to align the passageways 26 with the ports 22 and the openings 14. It is to be assumed that somewhere downhole of the system 10 the ID is plugged so that applied pressure from uphole of the system 10 finds an exit from the string only at or at least primarily at the openings 14. Because of this condition, applied pressure or acid is directed to a very small portion of the formation and fracture initiation is very likely to occur there and acid treatment will certainly be applied directly there. Accordingly, through use of the system and method hereof, great precision in fracture initiation or acidizing is effected.

Figure 3:
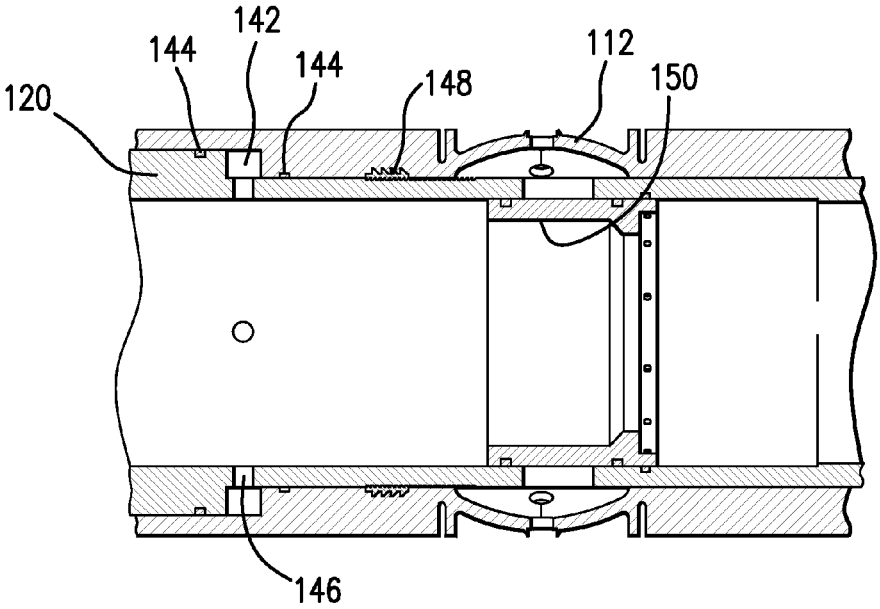
FIG. 3 is another embodiment of a formation treatment system in a run in position.
Figure 4:
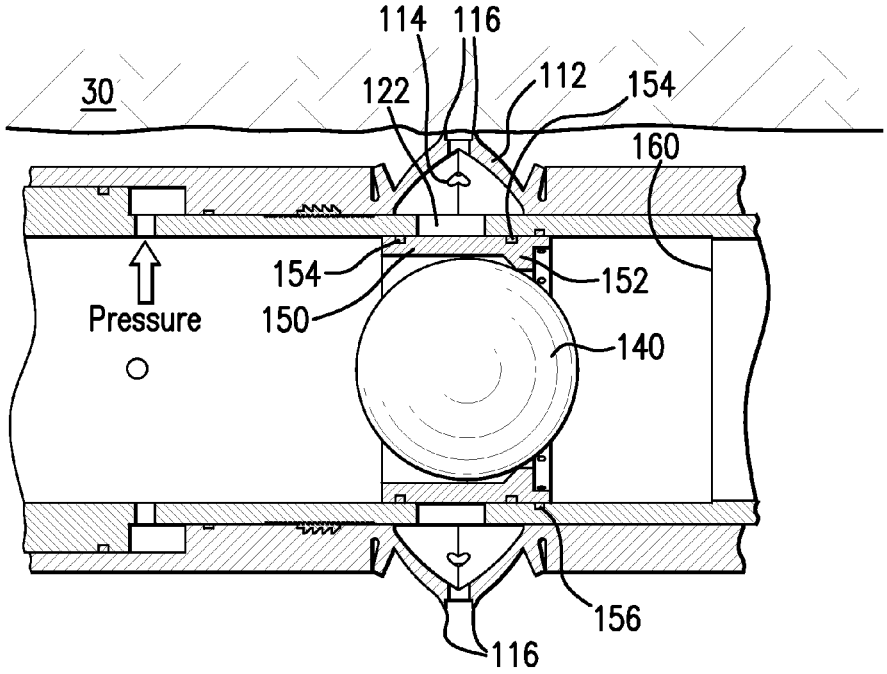
FIG. 4 is the formation treatment system of FIG. 3 in a setting position.
Figure 5:
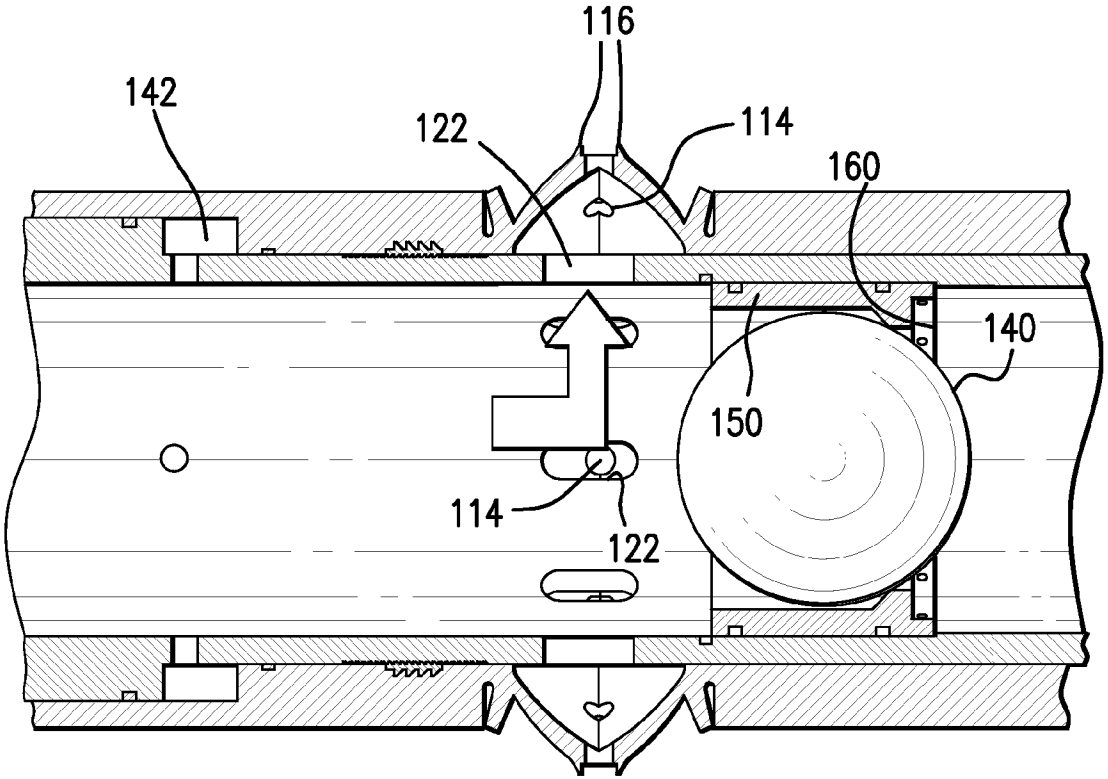
FIG. 5 is the formation treatment system of FIG. 3 in a formation treatment position.

In another embodiment, referring to FIGS. 3-5, a system 110 is illustrated that is similar to that of FIGS. 1 and 2 but is configured for use in situations where one or more fractures are planned or areas for acid treatment along a borehole are planned. More specifically, the system 110 employs a ball or other droppable or pumpable plug member 140 can be used to plug a particular system 110 to treat a certain target spot and then another plug 140 can be used for a next target spot and so on for as many systems 110 as are employed in a particular borehole.

The system 110 includes a member 112 similar to the member 12 of FIGS. 1 and 2 but that is actuated differently. The member 112 is configured to create a chamber 142 with tubing 120 upon which the member 112 may slide. The member 112 and tubing 120 are sealed to one another by o-rings 144 or equivalent. An actuation port 146 is located through the tubing 120 to allow pressure to be increased in the chamber 142 for actuation of the member 112.

The system 110 further includes in one embodiment a one way movement configuration 148, which in one embodiment may be a body lock ring or other ratcheting type configuration. The configuration 148 functions between the member 112 and tubing 120 to allow for the member 112 to move downhole relative to the tubing 120 (as illustrated but it is to be understood that this could be configured oppositely). The purpose and function of the configuration 148 is to accept movement imposed by the chamber 142 and then deny movement of the member 112 to a relaxed position after the force imposed by the chamber 148 is withdrawn.

System 110 further includes one or more openings 114 and one or more ports 122. The ports 122 and openings 114 are initially fluidly isolated from the ID of the system 110 by a sleeve 150. In one embodiment, the sleeve 150 includes an optional plug seat 152 receptive of a plug 140 as illustrated. The sleeve includes seals 154 that straddle the ports 122 during a nonoperational position of the system 110. Finally the system 110 includes a release mechanism 156 which in some embodiments may be a shear arrangement such as one or more shear screws.

Figure 6:
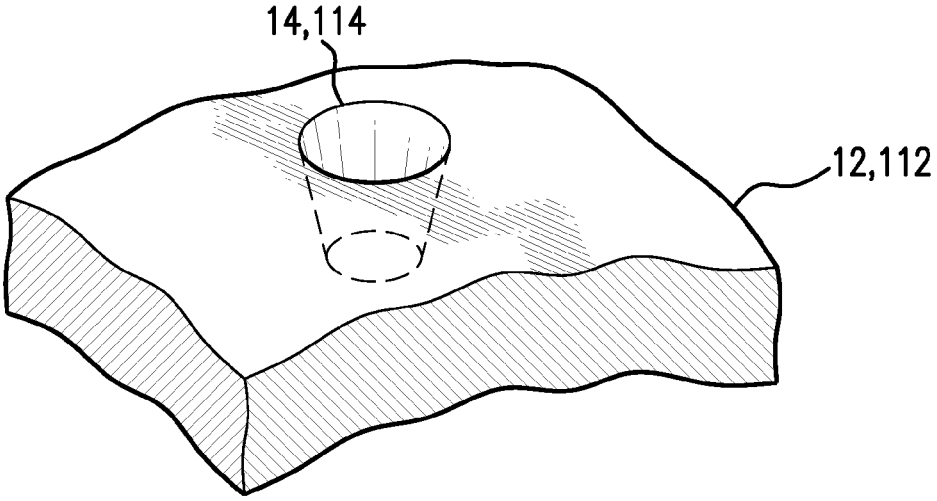
FIG. 6 is an enlarged schematic view of a portion of a annulus spanning member with a nozzle opening.

It is to be appreciated that the one or more openings 14 and 114 in annulus spanning members 12 and 112 can form a jet of fluid therethrough simply because the openings are relatively small in dimension. An even more effective jet can be formed if individual openings are configured through the thickness of the material of the annulus spanning member in a conical manner. The openings so configured would then act to some degree as nozzles. An enlarged schematic view of such is included as FIG. 6. Such a jet of fluid will aid in the initiation of a fracture by disrupting a surface of the formation through fluid erosion.

During use of the system 110, the system is run to a target location in a borehole and then a plug 140 is dropped or pumped to the location of the system 110. Upon seating in the seat 152, the plug 140 prevents fluid in the ID of the string from flowing past the seat 152. Referring to FIGS. 3 and 4, fluid pressure accordingly builds on an uphole side of the plug 140 (could be reversed for downhole if desired but must be upstream of the fluid flow). Increasing pressure acts upon chamber 142 to increase a dimension thereof that is longitudinal of the system 110. Increasing this dimension of the chamber 142 causes the member 112 to buckle radially outwardly toward and ultimately, in some embodiments, into contact with the formation 30. Referring to FIG. 5, once a threshold pressure is reached at which it is expected the member 112 will be fully deployed, the release member 156 releases and the sleeve 150 moves downhole (downstream) thereby opening the one or more ports 122 to allow the application of pressure to reach the openings 114 and the formation 30. Note that a shoulder 160 is provided to stop movement of the sleeve 150 after the one or more ports 122 are revealed. At this point the pressure can be increased to fracing pressure and the fracture will tend to initiate between pips 116 as in the embodiment of FIGS. 1 and 2 (or as noted above, acid can be applied to the formation between the pips. The system 110 can work with other systems 110 further upstream since after the treatment occurs as stated, flow is restored sufficiently to land another plug 140 at a more uphole sleeve 150 and the process as described again is repeated.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A formation treatment system comprising:

an annulus spanning member configured to, in use, come into contact with a borehole wall in which the system is to be installed, the annulus spanning member having one or more openings therein through which fluid is communicated to the formation, when the system is in use;

a tubular having one or more ports therein in fluid communication with the one or more openings;

a sleeve capable of isolating or communicating the one or more ports with an inside diameter of the tubular.

2. A formation treatment system as claimed in claim 1 wherein the annulus spanning member includes pips.

3. A formation treatment system as claimed in claim 1 wherein the sleeve includes one or more passageways that are alignable and misalignable with the one or more ports.

4. A formation treatment system as claimed in claim 1 wherein the sleeve further includes a plug seat.

5. A formation treatment system as claimed in claim 1 wherein the annulus spanning member and the tubular define a chamber.

6. A formation treatment system as claimed in claim 5 wherein the chamber is fluidly connected to the inside diameter of the tubular.

7. A formation treatment system as claimed in claim 4 wherein the sleeve is affixed to the tubular by a release member.

8. A formation treatment system as claimed in claim 7 wherein the release member is one or more shear screws.

9. A formation treatment system as claimed in claim 1 wherein the tubular includes a shoulder configured to stop movement of the sleeve.

10. A formation treatment system as claimed in claim 1 wherein the system includes a one way movement configuration.

11. A formation treatment system as claimed in claim 1 wherein the system is a fracture system.

12. A formation treatment system as claimed in claim 1 wherein the system is an acidizing system.

13. A method for effecting precision formation treatment comprising:

setting an annulus spanning member in contact with a formation to bring one or more openings in the annulus spanning member proximate a formation wall;

revealing one or more ports in a tubular member;

communicating a tubular inside diameter to the one or more openings in the annulus spanning member;

applying fluid through the tubular inside diameter; and directing the fluid to the formation through the one or more openings.

14. A method as claimed in claim 13 wherein the setting is by pressuring a chamber to force a body of the annulus spanning member to deform radially outwardly.

15. A method as claimed in claim 13 wherein the revealing includes delivering a plug to a plug seat in a sleeve member and moving the sleeve member.

16. A method as claimed in claim 15 wherein the moving the sleeve member includes releasing a release member.

17. A method as claimed in claim 13 wherein the setting includes actuating a one way movement configuration.

18. A method as claimed in claim 13 wherein the method is a fracture method.

19. A method as claimed in claim 13 wherein the method is an acidizing method.

20. A method for effecting precision formation treatment comprising:

deploying a plug member to a formation treatment system as claimed in claim 1;

setting the annulus spanning member in a formation to bring one or more openings in the annulus spanning member proximate a formation wall by pressurizing a chamber defined by the annulus spanning member and the tubular;

revealing one or more ports in the tubular member by moving the sleeve pursuant to pressure upon the plug on a seat in the sleeve;

communicating a tubular inside diameter to the one or more openings in the annulus spanning member;

applying a fluid through the tubular inside diameter; and directing the fluid to the formation through the one or more openings.

* * * * *